United States Patent [19]

Horodysky

[11] Patent Number: 4,581,037

[45] Date of Patent: Apr. 8, 1986

[54] AMIDES FROM DIALKYLENETRIAMINES AND LUBRICANT AND FUEL COMPOSITIONS CONTAINING SAME

[75] Inventor: Andrew G. Horodysky, Cherry Hill, N.J.

[73] Assignee: Mobil Oil Corporation, New York, N.Y.

[21] Appl. No.: 729,708

[22] Filed: May 2, 1985

Related U.S. Application Data

[62] Division of Ser. No. 541,814, Oct. 13, 1983, Pat. No. 4,551,257.

[51] Int. Cl.[4] ..... C10L 1/18; C10L 1/22

[52] U.S. Cl. ..... 44/53; 44/72

[58] Field of Search ..... 252/51.5 A; 564/152, 564/153; 44/53, 72

[56] References Cited

U.S. PATENT DOCUMENTS

| | | | |
|---|---|---|---|
| 3,778,372 | 12/1973 | Murphy | 252/51.5 A |
| 3,997,469 | 12/1976 | Howle | 252/51.5 A |
| 4,249,912 | 2/1981 | Holtz | 252/51.5 A |
| 4,303,535 | 12/1981 | Chou | 252/51.5 A |

*Primary Examiner*—Jacqueline V. Howard

*Attorney, Agent, or Firm*—Alexander J. McKillop; Michael G. Gilman; Van D. Harrison, Jr.

[57] ABSTRACT

Amides from N-hydrocarbyl hydrocarbylenetriamine, which can be made by the reaction of the appropriate triamine and organic monocarboxylic acid, demonstrate friction reducing properties when formulated into lubricants, particularly lubricating oils, and fuel consumption reduction properties when formulated into such lubricants or into fuels.

17 Claims, No Drawings

AMIDES FROM DIALKYLENETRIAMINES AND LUBRICANT AND FUEL COMPOSITIONS CONTAINING SAME

This is a division of copending application Ser. No. 541,814, filed Oct. 13, 1983, now U.S. Pat. No. 4,551,257.

BACKGROUND OF THE INVENTION

1. Field of the Invention

The invention relates to novel products and to their use in lubricants or liquid fuels to reduce friction and fuel consumption in internal combustion engine. More particularly, the invention relates to amides from certain hydrocarbyl hydrocarbylenetriamine and carboxylic acids and to lubricant and fuel compositions containing same.

2. Discussion of Prior Related Disclosures

As those skilled in this art know, additives impart special properties to lubricants. They may give the lubricants new properties or they may enhance properties already present. One property all lubricants have in common is the reduction of friction between materials in contact. Nonetheless, the art constantly seeks new materials to enhance such friction properties.

A lubricant, even without additives, when used in an internal combustion engine will not only reduce friction, but in the process will also reduce consumption of the fuel required to run it. When oils appeared to be inexhaustable, and cheap, minimum attention was given to developing additives for the specific purpose of increasing frictional properties or reducing fuel consumption. Instead, most of the advances in this area came as a result of additives being placed in lubricants for other purposes. However, recent events have added impetus to research programs designed specifically to find materials capable of enhancing the ability of lubricant to reduce friction.

It is probably generally understood in this art that there is not necessarily a correlation between friction reducing properties of an additive and its ability to correspondingly further reduce fuel consumption in an engine. That is, one cannot predict with certainty from the ability of an additive to reduce friction that it will also act to decrease fuel consumption. Thus, even though the use of amides in lubricants is known (see U.S. Pat. No. 3,884,822, for example, which discloses lubricants containing the product of reaction between an aminopyridine and oleic acid), no art teaches or suggests that the amides of this invention are useful for the purposes disclosed herein.

SUMMARY OF THE INVENTION

In accordance with the invention there is provided a lubricant or liquid fuel composition comprising a major proportion of a lubricant or fuel and an antifriction amount of a compound of the formula:

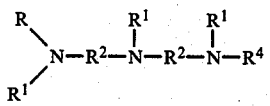

wherein R is a $C_{10}$ to $C_{30}$ hydrocarbyl group, $R^1$ is hydrogen or a

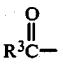

group, at least one of $R^1$ being the latter group in which $R^3$ is preferably hydrogen or a $C_1$ to $C_4$ hydrocarbyl group, preferably an alkyl group, e.g., a methyl, ethyl, propyl or butyl group and $R^2$ is a $C_2$ to $C_4$ hydrocarbylene group, preferably an alkylene group such as an ethylene, propylene or butylene group.

Some cyclization may also occur during the hereindescribed synthesis, but in general does not detract from the value of the products as antifriction agents.

As used herein, "hydrocarbyl" and "hydrocarbylene" are preferably alkyl and alkylene, respectively, but may include alkenyl and alkenylene. "Hydrocarbyl" also may include aryl, alkaryl, aralkyl and cycloalkyl groups, the aryl portions having 6 to 14 carbon atoms.

The invention also provides the compounds per se and a method of reducing fuel consumption in internal combustion engines by employing the disclosed fuel or lubricant compositions.

DESCRIPTION OF SPECIFIC EMBODIMENTS

The compounds of the invention can be made simply by heating a mixture of triamine and organic monocarboxylic acid at a temperature and for a time to form the amide. In general, the amide is made by reacting the appropriate triamine with an acid of the formula:

$R^3COOH$ wherein $R^3$ is as hereinabove described. Typical acids preferably include formic acid, and less preferably acetic and propionic acids.

The general reaction conditions are not critical. Reaction can take place between the triamine and the acid at a temperature of between about 80° C. and about 120° C., preferably about 100° C. to about 180° C. The reaction will usually be completed in from 2 to 10 hours, but where the reactants demand it, up to 24 hours may be required for reaction completion.

Hydrocarbon solvents, or other inert solvents may be used in the reaction. Included among the useful solvents are benzene, toluene and xylene. In general, any hydrocarbon solvent can be used in which the reactants are soluble and which can, if the products are soluble therein, by easily removed.

In carrying out the reaction, the molar ratio of triamine to acid preferably will range from about 1:1 to about 1:2.

Some of the useful triamines include N-oleyl diethylenetriamine, N-soya diethylenetriamine, N-coco diethylenetriamine, N-tallow diethylenetriamine, N-decyl diethylenetriamine, N-dodecyl diethylenetriamine, N-tetradecyl diethylenetriamine, N-octadecyl diethylenetriamine, N-eicosyl diethylenetriamine, N-triacontyl diethylenetriamine, N-oleyl dipropylenetriamine, N-soya dipropylenetriamine, N-coco dipropylenetriamine N-tallow dipropylenetriamine, N-decyl dipropylenetriamine, N-dodecyl dipropylenetriamine, N-tetradecyl dipropylenetriamine, N-octadecyl dipropylenetriamine, N-eicosyl dipropylenetriamine, N-triacontyl dipropylenetriamine, the corresponding N-$C_{10}$ to $C_{30}$ hydrocarbyl dibutylenetriamine members as well as the corresponding mixed members, as for example, the N-$C_{10}$ to $C_{30}$ hydrocarbyl ethylenepropylenetriamine, N-$C_{10}$ to $C_{30}$ hydrocarbyl ethylenebutylenetriamine and N-$C_{10}$ to $C_{30}$ hydrocarbyl propylenebutylenetriamine. All the R groups mentioned are alkyl or alkenyl. Others, such as an aryl group, an alkaryl group, an aralkyl group or a cycloalkyl group, as previously mentioned, may be used in effective additives.

An important feature of the invention is the ability of the additives to improve the friction qualities of oleaginous materials such as lubricating oils, which may be either a mineral oil a synthetic oil, or mixtures thereof, or a grease in which any of the aforementioned oils are employed as the vehicle. In general, mineral oils, both paraffinic, naphthenic or mixtures thereof, are employed as a lubricating oil or as the grease vehicle, they may be of any suitable lubricating viscosity range, as for example, from about 45 SSR at 100° F. to about 6000 SSU at 100° F., and preferably from about 50 to about 250 SSR at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the present invention.

In instances where synthetic oils are desired, various classes of oils may be successfully utilized. Typical synthetic vehicles include polyisobutylenes, polybutenes, hydrogenated polydecenes, polypropylene glycol, polyethylene glycol, trimethylol propane esters, neopentyl and pentaerythritol esters, di(2-ethylhexyl)-sebacate, di(2-ethylhexyl)adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes) and alkyl-substituted diphenyl ethers typified by a butyl-substituted bis(p-phenoxy phenyl)ether, phenoxy phenylethers. In preparing greases using synthetic oils, thickeners known to the art (including some of those mentioned hereinabove) can be used.

It is to be understood that the lubricant compositions contemplated herein can also contain other materials. For example, other corrosion inhibitors, extreme pressure agents, viscosity index improvers, coantioxidants, antiwear agents and the like can be used. These include, but are not limited to, phenates, sulfonates, succinimides, zinc dialkyl dithiophosphates, and the like. These materials do not detract from the value of the compositions of this invention; rather the materials serve to impart their customary properties to the particular compositions in which they are incorporated. In particular, the frictional properties of the compositions of this invention may be enhanced by the incorporation of from about 0.1% to about 2% by weight of metal phosphorodithioates, particularly zinc dialkyl dithiophosphates, made from low to moderate molecular weight alcohols such as propanol, butanol, pentanol, hexanol, octanol and the like, and mixtures thereof.

The products of this invention can also be employed in liquid hydrocarbon fuels, alcohol fuels or mixtures thereof, including mixtures of hydrocarbons, mixtures of alcohols and mixtures of hydrocarbon and alcohol fuels to reduce friction and improve fuel economy. About 25 pounds to about 500 pounds or preferably about 50 to 100 pounds, of amide per thousand barrels of fuel for internal combustion engines may be used. Liquid hydrocarbon fuels include gasoline, gasohol, fuel oils and diesel oils. Methyl and ethyl alcohols are examples of alcohol fuels. Other additives such as fuel dispersants, carburetor, detergents, stabilizers, antirust agents, demulsifiers metal deactivators, intake manifold detergents, dyes and the like can be used with our friction reducers in the fuel compositions.

In general, the reaction products of the present invention may be employed in any amount which is effective for imparting the desired degree of friction reduction and resulting fuel economy improvement and/or antioxidant activity. In lubricant applications, the product is effectively employed in amounts from about 0.1% to about 10% by weight, and preferably from about 1% to about 5% of the total weight of the composition.

The following Examples will present illustrations of the invention. They are illustrative only, and are not meant to limit the invention.

EXAMPLE 1

N-Oleyl Dipropylenetriamine-Formic Acid Product

Approximately 110 g of N-oleyl dipropylenetriamine (commercially obtained as Triamine OL from Armak Chemical Co.), 100 g of toluene and 13 g of 88% formic acid were charged to a 1 liter flask equipped with heater, agitator, Dean-Stark tube with condenser and a means to blanket the vapor space with nitrogen. The reaction mixture was slowly heated 180° C. over a period of 6 hours until water evolution as a result of azeotropic distillation ceased. The solvent was removed by vacuum distillation at 180° C.

EXAMPLE 2

N-Tallow Dipropylenetriamine-Formic Acid Product

Approximately 108 g of N-tallow dipropylenetriamine (commercially obtained as Armosperse 300 from Armak Chemical Co.), 75 g of toluene and 13 g of 88% formic acid were added to a reactor equipped as described in Example 1. The reaction mixture was slowly heated up to 170° C. over a period of 6 hours until water evolution as a result of azeotropic distillation ceased. The solvent was removed by vacuum distillation at 170° C.

EXAMPLE 3

N-Tallow Dipropylenetriamine-Formic Acid Product

Approximately 108 g of the N-tallow dipropylenetriamine described in Example 2, 75 g of toluene and 26 g of 88% formic acid (twice the amount used in Example 2) were added to a reactor equipped as described in Example 1. The reaction mixture was slowly heated up to 170° C. over a period of 6 hours until water evolution as a result of azeotropic distillation ceased. The solvent was removed by vacuum distillation at 170° C.

EXAMPLE 4

N-Tallow Dipropylenetriamine-Formic Acid Product

Approximately 108 g of the N-tallow dipropylenetriamine described in Example 2, 75 g of toluene and 39 g of 88% formic acid (three times the amount used in Example 2) were added to a reactor equipped as described in Example 1. The reaction mixture was heated up to 170° F. over a period of 6 hours until water evolution as a result of azeotropic distillation ceased. The solvent was removed by vacuum distillation at 170° C.

EVALUATION OF THE COMPOUNDS

The compounds were evaluated in Low Velocity Friction Apparatus (LVFA) in a fully formulated mineral or synthetic, automative engine oil containing an additive package including antioxidant, dispersant and detergent, and metallic dithiophosphate. Although evaluation of additives was performed in lubricant formulations, these results correlate well with expected frictional and fuel economy improvements when these same additives are used in fuels burned in internal combustion engines. For example, this test predicts the reduction in friction of the piston rings moving against the cylinder walls that have been wetted by the additive blended into the fuel. The resulting reduction in friction observed, if any, may translate into an improvement in economy of the fuel actually consumed. Additionally, these additives when used in fuels, may actually help reduce wear of the internal combustion engine parts.

Description

The Low Velocity Friction Apparatus (LVFA) is used to measure the coefficient of friction of test lubricants under various loads, temperatures, and sliding speeds. The LVFA consists of a flat SAE 1020 steel surface (diameter 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal the the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cammotor arrangement.

Procedure

The rubbing surfaces and 12–13 ml of test lubricants are placed on the LVFA. A 240 psi load is applied and the sliding speed is maintained at 40 fpm at ambient temperature for a few minutes. A plot for coefficients of friction ($U_k$) vs. speed were taken at 240, 300, 400, and 500 psi. Freshly polished steel specimens are used for each run. The surface of the steel is parallel ground to 4 to 8 microinches. The results in Table 1 refer to percent reduction infriction compared to the unmodified oil. That is, the formulation mentioned above was tested without the compound of this invention and this became the basis for comparison. The results were obtained at 250° F. and 500 psi.

TABLE 1

Frictional Properties Using the Low Velocity Friction Apparatus

| | Additive Conc. Wt. % | Percent Reduction In Coefficient of Friction 5 Ft./Min. | 30 Ft./Min. |
|---|---|---|---|
| Base Oil A (fully formulated synthetic oil containing detergent/dispersant/inhibitor package) SAE 5W-30 | — | 0 | 0 |
| Example 1 - Plus Base Oil | 2 | 15 | 15 |
| Example 2 - Plus Base Oil | 2 | 17 | 14 |
| Example 3 - Plus Base Oil | 2 | 23 | 20 |
| Example 4 - Plus Base Oil | 2 | 23 | 16 |

TABLE 2

| | Additive Concn., Wt. % | Percent Reduction in Coefficient of Friction 5 Ft./Min. | 30 Ft./Min. |
|---|---|---|---|
| Base Oil B (fully formulated mineral oil containing detergent/dispersant/inhibitor package) SAE 10W-40 | — | 0 | 0 |
| Example 1 - Plus Base Oil | 2 | 22 | 20 |
| | 1 | 20 | 17 |
| Example 3 - Plus Base Oil | 2 | 28 | 12 |
| Example 4 - Plus Base Oil | 2 | 36 | 23 |

The oxidation stability of the additives were determined by evaluation of additive blends in 200 second solvent paraffinic neutral lubricating oil using the Catalytic Oxidation Test at 325° F. for 40 hours. The tests were run in the presence of samples of iron, copper and aluminum.

TABLE 3

Oxidation Characteristics
Catalytic Oxidation Test, 40 Hrs @ 325°F.

| | Additive Concn., Wt. % | % Increase in Viscosity of Oxidized Oil Using KV @ 100 C | Neut. Number | Lead Loss, Mg |
|---|---|---|---|---|
| Base Oil (200 Second Solvent Paraffinic Lubricating Oil) | — | 67 | 3.62 | −1.2 |
| Example 1 - Plus Base Oil | 1 | 41 | 3.66 | 0.0 |
| Example 2 - Plus Base Oil | 2 | 18 | 2.53 | 1.0 |
| Example 3 - Plus | 2 | 17 | 3.07 | 2.0 |
| Base Oil | 1 | 23 | 3.85 | 1.0 |

The results show the stability exhibited by these multipurpose friction reducers under severe oxidizing conditions. They may also, on occasion, be used to predict the oxidative and thermal stabilities of the additives when used in fuel compositions for internal combustion engines.

I claim:

1. A liquid fuel composition comprising a major proportion of a liquid fuel and an antifriction amount of a compound having the formula

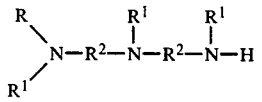

wherein R is a $C_{10}$ to $C_{30}$ hydrocarbyl group, $R^1$ is hydrogen or

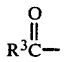

group, at least one of $R^1$ being the latter group in which $R^3$ is hydrogen or a $C_1$ to $C_4$ hydrocarbyl group and $R^2$ is a $C_2$ to $C_4$ hydrocarbylene group.

2. The composition of claim 1 wherein R is selected from the group consisting of alkyl, alkenyl, aryl, alkaryl, aralkyl and cycloalkyl.

3. The composition of claim 2 wherein the aryl portion has 6 to 14 carbon atoms.

4. The composition of claim 2 wherein R is selected from the group consisting of alkyl and alkenyl.

5. The composition of claim 4 wherein R is selected from the group consisting of oleyl, soya, coco, tallow, decyl, dodecyl, tetradecyl, octadecyl, eicosyl, triacontyl and mixtures thereof.

6. The composition of claim 1 wherein $R^2$ is an alkylene group.

7. The composition of claim 6 wherein the alkylene group is selected from the group consisting of ethylene, propylene, butylene and mixtures thereof.

8. The composition of claim 1 wherein $R^3$ is an alkyl group.

9. The composition of claim 8 wherein the alkyl group is a methyl, ethyl, propyl or butyl group.

10. The composition of claim 1 wherein $R^3$ is hydrogen.

11. The composition of claim 1 wherein the compound has the formula

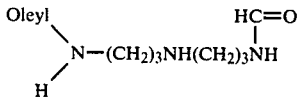

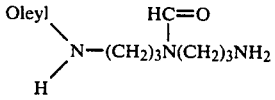

or

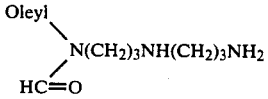

12. The composition of claim 1 wherein the compound has the formula

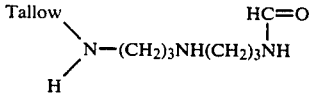

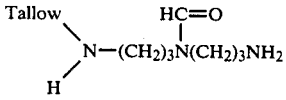

or

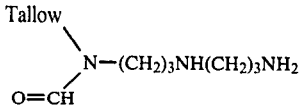

13. The composition of claim 1 additionally containing a phenate, sulfonate, succinimide or metal dialkyl phosphorodithioate.

14. The composition of claim 13 wherein the additional agent is zinc dialkyl phosphorodithioate wherein the alkyl group is selected from the group consisting of propyl, butyl, pentyl, hexyl and octyl.

15. The composition of claim 1 wherein the liquid fuel is a liquid hydrocarbon, a liquid alcohol or a mixture of same.

16. The composition of claim 15 wherein the hydrocarbon is gasoline, fuel oil or diesel oil.

17. The composition of claim 15 wherein the alcohol is methyl or ethyl alcohol.

* * * * *